US007645489B2

(12) United States Patent
Ozawa et al.

(10) Patent No.: US 7,645,489 B2
(45) Date of Patent: Jan. 12, 2010

(54) PROCESS FOR PRODUCING INKJET RECORDING MEDIUM

(75) Inventors: Yuji Ozawa, Tokyo (JP); Akinobu Chatani, Tokyo (JP); Kunio Takebayashi, Tokyo (JP); Takashi Ochi, Tokyo (JP); Dai Nagahara, Tokyo (JP); Koichi Yanai, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 263 days.

(21) Appl. No.: 10/541,300

(22) PCT Filed: Aug. 3, 2004

(86) PCT No.: PCT/JP2004/011084

§ 371 (c)(1),
(2), (4) Date: Jun. 30, 2005

(87) PCT Pub. No.: WO2005/018946

PCT Pub. Date: Mar. 3, 2005

(65) Prior Publication Data

US 2006/0168811 A1 Aug. 3, 2006

(30) Foreign Application Priority Data

Aug. 26, 2003 (JP) ..... 2003-301018

(51) Int. Cl.
*B05D 1/28* (2006.01)

(52) U.S. Cl. ..... 427/428.01; 428/32.1; 428/32.24; 428/32.38; 428/32.34

(58) Field of Classification Search ..... 428/32.1, 428/32.24, 32.38, 32.34; 427/428.01
See application file for complete search history.

(56) References Cited

U.S. PATENT DOCUMENTS

| | | | | |
|---|---|---|---|---|
| 4,191,742 | A * | 3/1980 | Wason et al. | 424/49 |
| 4,460,637 | A * | 7/1984 | Miyamoto et al. | 428/32.32 |
| 4,725,318 | A * | 2/1988 | Minayoshi et al. | 106/465 |
| 4,892,591 | A | 1/1990 | Ogawa et al. | |
| 5,013,603 | A * | 5/1991 | Ogawa et al. | 428/331 |
| 5,281,467 | A * | 1/1994 | Shimada et al. | 428/32.36 |
| 5,576,088 | A | 11/1996 | Ogawa | |
| 5,972,167 | A * | 10/1999 | Hayasaka et al. | 162/135 |
| 6,312,794 | B1 * | 11/2001 | Sekiguchi et al. | 428/32.21 |
| 6,402,824 | B1 * | 6/2002 | Freeman et al. | 106/464 |
| 6,410,123 | B1 | 6/2002 | Otani et al. | |
| 6,623,555 | B1 * | 9/2003 | Haverinen et al. | 106/465 |
| 6,773,770 | B1 | 8/2004 | Sugiyama et al. | |
| 6,846,524 | B2 | 1/2005 | Ozawa et al. | |
| 2002/0055552 | A1 | 5/2002 | Schliesman et al. | |

FOREIGN PATENT DOCUMENTS

| | | | | |
|---|---|---|---|---|
| EP | 0450540 | | | 10/1991 |
| EP | 582466 | A | | 2/1994 |
| EP | 734882 | B1 | | 3/1996 |
| EP | 730 976 | B1 | | 6/1999 |
| JP | 61118287 | A | * | 6/1986 |
| JP | 63-306074 | A | | 12/1988 |
| JP | 01-141783 | | | 6/1989 |
| JP | 04-219267 | | | 8/1992 |
| JP | 04-219267 | A | | 8/1992 |
| JP | 04-305247 | A | | 10/1992 |
| JP | 05-59694 | A | | 3/1993 |
| JP | 06-025997 | | | 2/1994 |
| JP | 06-72017 | A | | 3/1994 |
| JP | 07-329412 | | | 12/1995 |
| JP | 08-187932 | | | 7/1996 |
| JP | 08-258396 | | | 10/1996 |
| JP | 11107189 | A | * | 4/1999 |
| JP | 2000-238536 | A | | 9/2000 |
| JP | 2001-138626 | A | | 5/2001 |
| JP | 2001-205933 | A | | 7/2001 |
| JP | 2001247310 | A | * | 9/2001 |
| JP | 2002-127587 | | | 5/2002 |
| JP | 2002-293001 | A | | 10/2002 |
| JP | 2003-049389 | A | | 2/2003 |

* cited by examiner

*Primary Examiner*—Michael Kornakov
*Assistant Examiner*—Robert S Walters, Jr.
(74) *Attorney, Agent, or Firm*—Gary C. Cohn PLLC

(57) ABSTRACT

A method for manufacturing an inkjet recording medium comprising the steps of: applying a coating color containing a pigment and a binder as major components to at least one side of a base material using a transfer roll coater, subsequently drying coating layer to form an ink absorbing layer, wherein Hercules viscosity of coating color is 5 m Pa·s to 30 m Pa·s and pigment contains a synthetic silica having an oil absorption of 90 ml/10 g to 200 ml/100 g, a BET specific surface area of 45 $m^2/g$ to 200 $m^2/g$ and an average particle diameter of 1.0 μm to 3.0 μm and/or a precipitated calcium carbonate-silica composite having an oil absorption of 100 ml/10 g to 250 ml/100 g, a BET specific surface area of 5 $m^2/g$ to 150 $m^2/g$ and an average particle diameter of 1.0 μm to 10 μm.

16 Claims, No Drawings

PROCESS FOR PRODUCING INKJET RECORDING MEDIUM

BACKGROUND OF THE INVENTION

1. Field of the Invention

The present invention relates to a method for manufacturing an inkjet recording medium of which the ink absorbing layer is formed using a transfer roll coater.

2. Description of the Prior Art

Inkjet recording method involves ejecting small droplets of ink using various mechanisms and forming images and letters by allowing the droplets onto a recording medium such as paper. This recording method has become phenomenally popular in homes since it readily performs at high speed and provides full color prints, less noisy in printing, and the printing devices are inexpensive. In commercial applications, non-impact printing (NIP) has been previously used to print variable information (invoices and receipts for public fees and credits, shipping bills, advertisements and the like), and high speed inkjet printers having a line head recently started to replace existing methods.

The recording medium used for inkjet recording is roughly classified into a non-coated paper type on which an ink absorbing layer containing a pigment has not been formed and a coated paper type on which an ink absorbing layer containing a pigment has been formed. The less expensive non-coated paper is ordinarily used for home page printing and business reports and the coated paper that can reproduce high resolution images is used to print outputs from digital cameras and the like.

Especially, the inkjet recording comes to have various uses, and a coated paper type inkjet recording medium that can be printed on both sides and can reproduce high resolution images inexpensively is needed. In order to improve productivity and reduce the cost of inkjet recording medium production, a technology that enables the use of an on-machine coater is urgently needed.

In addition, offset printability is also needed in an inkjet recording medium since, in some cases, backgrounds (borders, logo marks and the like) are printed first using offset printing before inkjet printing is used.

As a technology for manufacturing an inkjet recording medium using an on-machine coater, a technology in which an inkjet recording paper that can be printed using an offset printing method is manufactured using an on-machine coater (see, for example, Unexamined Japanese Patent Publication (Kokai) 2002-127587) and a technology for manufacturing an inkjet recording paper having the feel of non-coated paper (see, for example, Unexamined Japanese Patent Publication (Kokai) Hei 4-219267) have been disclosed. In addition, as a technology to manufacture general purpose printing paper at high speed, a technology to manufacture a coated paper for printing using a gate roll coater (see, for example, Unexamined Japanese Patent Publication(Kokai) Hei 6-25997) has been disclosed.

SUMMARY OF THE INVENTION

However, the on-machine coater used in the technology described above(Kokai 2002-127587) accepts only an air knife coater, and it is difficult to use other on-machine coaters such as a transfer roll coater (a gate roll coater, a rod metering size press, a blade metering size press and the like) in this method. When a transfer roll coater is used to apply a coating, the high shear viscosity of the coating needs to be lowered. When solid content in a coating is decreased to lower the high shear viscosity of a coating in the technology described above (Kokai 2002-127587), it is difficult to achieve designated coating weight using a transfer roll coater. When, on the contrary, solid content in a coating is increased to obtain a designated coating weight, coating defects are encountered when using a transfer roll coater. And it is hard to deliver an inkjet recording medium that can be printed on two sides using an air knife coater, since it is difficult to inexpensively manufacture an inkjet recording medium having ink absorbing layers on both sides using a air knife coater.

In the case of the technology described above(Kokai Hei 4-219267), Brookfield viscosity at a low shear rate when applying a coating for a film layer on a base paper is very high and is from 1 Pa·s to 100 Pa·s. Therefore, coating defects caused by split patterns when the paper is removed from a roll are noticeable when a film transfer roll coater is used in a high speed coating process, making high speed coating treatment difficult. In addition, an object of this technology is to deliver the feel of an non-coated paper, and the proportion of a pigment present in the coating layer is therefore low. Therefore, ink absorption capacity is lacking in this technology, and adequate inkjet printability sometimes cannot be obtained.

The technology described above (Kokai Hei 6-25997) is simply a disclosure of a commonly practiced production technology for pigment-coated paper, and the inkjet printability is not investigated.

Therefore, the object of the present invention is to provide a method for manufacturing an inkjet recording medium that can be manufactured using a transfer roll coater which can be apply to offset printing, has excellent inkjet recording printability and is adaptable to high speed coating.

The inventors diligently studied to solve the problems described above. As a result, the inventors discovered that an ink absorbing layer having excellent performance can be prepared using a transfer roll coater by using a coating color of a designated viscosity and the pigment contains a designated silica or a precipitated calcium carbonate-silica composite.

That is, the object of the present invention described above is achieved by a method for manufacturing an inkjet recording medium comprising the steps of: applying a coating color containing a pigment and a binder as major components to at least one side of a base material using a transfer roll coater; subsequently drying said coating layer to form an ink absorbing layer, wherein Hercules viscosity of said coating color is 5 m Pa·s to 30 m Pa·s and said pigment contains a synthetic silica having an oil absorption of 90 ml/100 g to 200 ml/100 g, a BET specific surface area of 45 $m^2/g$ to 200 $m^2/g$ and an average particle diameter of 1.0 μm to 3.0 μm and/or a precipitated calcium carbonate-silica composite having an oil absorption of 100 ml/100 g to 250 ml/100 g, a BET specific surface area of 5 $m^2/g$ to 150 $m^2/g$ and an average particle diameter of 1.0 μm to 10 μm.

Preferably, said synthetic silica is obtained by wet grinding a synthetic silica slurry obtained by neutralizing an aqueous sodium silicate solution using a mineral acid and/or an aqueous acidic metal salt solution, and said synthetic silica is obtained by neutralizing an aqueous sodium silicate solution using an aqueous aluminum sulfate solution.

Preferably, said precipitated calcium carbonate-silica composite is obtained by mixing a precipitated calcium carbonate with an aqueous alkalin metal silicate solution and adjusting pH of said mixed solution to 7-9 by adding a mineral acid at a temperature below the boiling point of said mixed solution, and the ratio by weight for precipitated calcium carbonate/silica in said precipitated calcium carbonate-silica composite is 30/70 to 70/30 in terms of solid content.

In addition, preferably, the method further comprising the step of adding said synthetic silica obtained by wet grinding said synthetic silica slurry and/or said precipitated calcium carbonate-silica composite obtained by adjusting said pH to said coating color without proceeding through a drying step. And preferably, said pigment contains said synthetic silica and/or said precipitated calcium carbonate-silica composite and a precipitated calcium carbonate having an average particle diameter of 0.2 μm to 1.0 μm.

Preferably, said transfer roll coater is a gate roll coater, the coating weight of said ink absorbing layer per one side is 2 $g/m^2$ to 7 $g/m^2$, and said coating color contains a cationic resin.

DESCRIPTION OF THE PREFERRED EMBODIMENTS

The preferred embodiments of the present invention are explained below. A method of the present invention for manufacturing an inkjet recording medium is used to form an ink absorbing layer on at least one side of a base material by applying the coating color described below using a transfer roll coater. The ink absorbing layer can be applied to both sides when necessary.

Any sheet shaped base material may be used in the present invention, but uncoated paper prepared using wood fiber as a raw material is particularly preferred. This paper is composed of mainly paper making pulp. Chemical pulps such as LBKP, NBKP and the like, mechanical pulps such as GP, TMP and the like and recycled pulp may be cited as the pulp for paper making. The invention is not particularly restricted as described above, and the pulps may be used individually or in combinations as needed. Furthermore, the use of various internal agents such as fillers, sizing agents, paper strengthening additives and the like present in a stock paper is not particularly restricted and such agents may be appropriately selected from well known fillers and various internal agents. In addition, a antifoaming agent, a pH adjusting agent, dyes, organic pigments, fluorescent dyes and the like may also be internally added to a stock paper when necessary.

An ink absorbing layer is formed by applying a coating color containing pigments and binders as major components and having a designated viscosity. The viscosity of the coating color is discussed later.

<Pigment in the Coating Color>

The pigment in the coating color contains a synthetic silica having an oil absorption of from 90 ml/100 g to 200 ml/100 g or preferably from 100 ml/100 g to 180 ml/100 g, a BET specific surface area of from 45 $m^2/g$ to 200 $m^2/g$ or preferably from 60 $m^2/g$ to 200 $m^2/g$ and an average particle diameter of from 1.0 μm to 3.0 μm and/or a precipitated calcium carbonate-silica composite having an oil absorption of from 100 ml/100 g to 250 ml/100 g or preferably from 110 ml/100 g to 240 ml/100 g, a BET specific surface area of from 5 $m^2/g$ to 150 $m^2/g$ or preferably from 10 $m^2/g$ to 130 $m^2/g$ and an average particle diameter of from 1.0 μm to 10 μm.

<Synthetic Silica>

When the oil absorption of the synthetic silica mentioned above is under 90 ml/100 g, the ink absorption performance of the ink absorbing layer declines. When the same exceeds 200 ml/100 g, the surface strength of the ink absorbing layer declines (for example, the offset printability declines). In addition, when the BET specific surface area of a synthetic silica is under 45 $m^2/g$, the ink absorption performance declines. When the same exceeds 200 $m^2/g$, the viscosity of the coating color rises and adversely affects operations (for example, the on-machine runnability of the coating). In addition, when the average particle diameter of the synthetic silica is under 1.0 μm, the amount of silica void declines, It is difficult to retain ink and ink penetrates into the inside of the coating layer or the base material, the optical(image) density declines. Simultaneously, when the average particle diameter exceeds 3.0 μm, opacity of the silica itself rises, and lowering the optical density. The average silica particle diameter may be measured using a laser particle size analyzer (for example, Mastersizer S, a trade name of Malvern Instruments).

The use of a synthetic silica obtained by a wet grinding treatment of a synthetic silica slurry obtained by neutralizing an aqueous sodium silicate solution using a mineral acid and/or an aqueous acidic metal salt solution as the synthetic silica mentioned above is preferred since both inkjet printability and offset printability are imparted. Alkaline earth metal elements such as magnesium, calcium, strontium, barium and the like or titanium, zirconium, nickel, iron, aluminum and the like, for example, can be mentioned as the metal element in the aqueous acidic metal salt solution mentioned above. Acidic metal sulfate salt solutions can be cited as the aqueous acidic metal salt solution. The use of an aqueous aluminum sulfate solution that is an acidic metal sulfate salt is particularly preferred since it not only increases the concentration of a coating color in terms of solid content but also can maintain a low Hercules viscosity (high shear viscosity) even when said concentration in terms of solid content is high.

In addition, the preferred amount of the aqueous acidic metal salt solution added is from 5% to 60% (% per neutralization equivalent) per sodium silicate neutralization equivalent, and the use of an added mineral acid is preferred. A mineral acid and/or an aqueous acidic metal salt solution are used to neutralize when obtaining a synthetic silica slurry by neutralizing sodium silicate, and both a mineral acid and an aqueous acidic metal salt solution are preferably used. The preferred compounding ratio in terms of equivalents is (mineral acid: aqueous acidic metal salt solution)=from 95:5 to 40:60. When both a mineral acid and an aqueous acidic metal salt solution are used, they can be individually and successively used for the neutralization or a mixture of the two can be used for the neutralization. The synthetic silica mentioned above can be obtained by wet grinding a synthetic silica slurry obtained using the method described in Unexamined Japanese Patent Publication(Kokai) 2002-274837 using a known grinder(a sand grinder and the like).

<Precipitated Calcium Carbonate-Silica Composite>

A precipitated calcium carbonate-silica composite is thought to be endowed with the properties of silica and the properties of precipitated calcium carbonate. The advantage is that the viscosity of a coating color, the ink absorption performance of the ink absorbing layer obtained and the optical density can be suitably adjusted by adjusting their mixing proportions. The reason for specifying the range of oil absorption, BET specific surface area and average particle diameter for a precipitated calcium carbonate-silica composite is the same reason mentioned above for synthetic silica. A precipitated calcium carbonate/silica ratio by weight in terms of solid content ($CaCO_3/SiO_2$) of from 30/70 to 70/30 is preferred for the precipitated calcium carbonate-silica composite. When the ratio mentioned above is under 30/70, the composite may becomes unnecessary since the properties of silica overwhelm and the use of the synthetic silica mentioned above may becomes advantageous from the standpoint of the ease of manufacturing. When the ratio mentioned above exceeds 70/30, the properties of precipitated calcium carbonate become overwhelming and the ink absorption performance of the ink absorbing layer and optical density tend to decline.

The crystal structure (polymorphism) of the precipitated calcium carbonate ($CaCO_3$) used to manufacture a precipitated calcium carbonate-silica composite may be either calcite or Aragonite. The shape of the precipitated calcium carbonate mentioned above may be any one of shapes including a needle shape, a column shape, a spindle shape, a sphere shape, a cube shape and a rosette shape. The rosette shape may refers to a form where spindle shaped primary particles of precipitated calcium carbonate are aggregated into round balls. The use of rosette shaped calcite type precipitated calcium carbonate is particularly preferred since the absorption properties of the pigment are good and the inkjet adaptability (particularly the ink absorption performance) of the ink absorbing layer obtained is improved.

<Production of the Precipitated Calcium Carbonate-Silica Composite>

The precipitated calcium carbonate-silica composite described above is obtained, for example, by adding a mineral acid to a solution obtained by mixing precipitated calcium carbonate with an aqueous alkaline metal silicate solution at a temperature below the boiling point to adjust the pH of the solution to 7-9. A coating color containing a precipitated calcium carbonate-silica composite obtained in the manner described above is preferred as the pigment since the Hercules viscosity is low even when the concentration in terms of solids content is high. According to this method, the composite formed is thought to contain a silica cover on the surface of precipitated calcium carbonate.

The method described above involves dispersing the precipitated calcium carbonate mentioned above in water and adding an alkaline solution (the alkali employed, for example, is sodium or potassium) of silicic acid. The mole ratio of silicic acid to the alkali is not restricted, but No. 3 silicic acid (about $SiO_2$:$Na_2O$=3:1-3.4:1) is most commonly available and is preferable for use. The ratio by weight in terms of solid content ($CaCO_3/SiO_2$) mentioned above can be adjusted by adjusting the weight ratio of the amounts of precipitated calcium carbonate and the alkaline solution of silicic acid added.

A precipitated calcium carbonate-silica composite can be manufactured by next agitating and dispersing the mixture and subsequently utilizing a neutralization reaction with a mineral acid. Any mineral acid may be used, and, in addition, the mineral acid may also contain an acidic metal salt such as aluminum sulfate and magnesium sulfate. The addition of a mineral acid (also the acid containing the aqueous acidic metal salt solution mentioned above as the mineral acid) is conducted at a temperature below the boiling point of the mixture mentioned above to obtain a precipitated calcium carbonate-silica composite by forming a covering of amorphous silicic acid by allowing a silicic acid fraction to be deposited on the surface of precipitated calcium carbonate particles. It is important that this neutralization reaction may be completed at pH=7-9. When the pH is under 7, decomposition of the precipitated calcium carbonate may occurs. When the pH exceeds 9, the depositon of the silicic acid fraction may not proceed sufficiently and a loss may be incurred because unreacted silicic acid fraction remains.

The average particle diameter of a precipitated calcium carbonate-silica composite can be adjusted by forcefully agitating or grinding the particles during the aging step of the neutralization reaction, or by grinding the solids of solid-liquid separation with wet grinder after completion of the neutralization reaction or the reaction. The term "aging" refers to a step in which the acid addition is temporarily paused when neutralizing and the reaction mixture is allowed to stand with only agitation.

<Other Pigments>

The synthetic silica mentioned above and the precipitated calcium carbonate-silica composite may be used individually or in combination as the pigment for a coating color. The pigment for a coating color may comprise only the synthetic silica mentioned above and/or the precipitated calcium carbonate-silica composite, but, in addition, any one of the pigments ordinarily used in coated paper such as ground calcium carbonate, precipitated calcium carbonate, kaolin, calcined clay, organic pigment, titanium oxide and the like may also be used in combination in addition to the synthetic silica and/or the precipitated calcium carbonate-silica composite. These pigments ordinarily used in coated paper may, for example, be added at from about 20% by weight to 80% by weight based on the total pigment in a coating color. However, the combined use of precipitated calcium carbonate having an average particle diameter of from 0.2 μm to 1 μm with the synthetic silica and/or the precipitated calcium carbonate-silica composite described above is preferred since the concentration in terms of solid content in the coating color is increased more while preventing a decline in optical density, and the use of needle shaped precipitated calcium carbonate is particularly preferred.

In addition, a weight ratio of (silica/precipitated calcium carbonate) of from 20/80 to 80/20 based on total pigment is preferred due to a higher concentration of the coating color and improved surface strength in the coating layer. In this case, silica in the numerator refers to the silica fraction based on total pigment, and the precipitated calcium carbonate in the denominator indicates the precipitated calcium carbonate fraction (derived from the precipitated calcium carbonate-silica composite and the precipitated calcium carbonate having an average particle diameter of 0.2 μm to 1 μm) based on total pigment.

<Addition of Synthetic Silica and/or a Precipitated Calcium Carbonate-Silica Composite to a Coating Color>

The manufacturing cost of a coating color can be reduced and an inexpensive inkjet recording paper can be manufactured by preferably mixing a synthetic silica obtained by wet grinding the synthetic silica slurry described above and/or the precipitated calcium carbonate-silica composite formed in the neutralization reaction described above with a coating color without proceeding through a drying step.

<Binders>

The coating color binder is not particularly restricted and can appropriately be selected from, for example, well known resins, but those that are soluble or dispersible in water such as water soluble polymer adhesives, synthetic emulsion type adhesives and the like are desirable. As the water soluble polymer adhesives, starch and its modifications, poly(vinyl alcohol) and its modifications, casein and the like may be cited. In addition, acrylic resin type emulsions, vinyl acetate resin type adhesives, styrene butadiene latex, urethane resin type emulsions and the like may be cited as the synthetic emulsion type adhesives. However, the use of a water soluble polymer adhesive is desirable from the standpoint of optical density. More specifically, completely hydrolyzed poly(vinyl alcohols), partially hydrolyzed poly(vinyl alcohols), cation modified poly(vinyl alcohols), anion modified poly(vinyl alcohols), silanol modified poly(vinyl alcohols), oxidized starch, hydroxyethyl etherified starch, phosphoric acid esterified starch and the like can be cited.

The Hercules viscosity of a coating color also tends to be high particularly when the Hercules viscosity of a binder is high. Therefore, the use of a binder having a low Hercules viscosity even at high concentrations (for example, PVA having a degree of polymerization of 1,000 or less and hydroxyethyl etherified starch) is preferred.

<Cationic Resin>

Preferably, an ink absorbing layer (that is, in a coating color) contains a cationic resin that acts as a dye fixing agent in one embodiment the present invention since this imparts water resistance to the anionic inkjet ink.

The cationic resin is a cationic water soluble polymer, and the use of those having an anion demand of 5 meq/g or more and a molecular weight of 5,000-200,000 is desirable from the standpoint of improving ink water resistance. The reason is presumed as follows. That is, an inkjet ink is thought to be adsorbed on micro voids inside a pigment and on the pigment surface. Then, to make this ink water resistant, the cationic resin that bonds with the ink needs to be distributed on microscopic voids inside a pigment and on a pigment surface in an ink absorbing layer. However, the cationic resin cannot be distributed on the voids inside a pigment when the molecular weight of the cationic resin exceeds 200,000 and no water resistance can be imparted to the ink that entered the voids inside the pigment. On the other hand, ink can be distributed to the microscopic voids and water resistance can be imparted to the ink that had entered the inside of pigment, but optical density declines due to the fixing of the ink on the pigment inside when the molecular weight of the cationic resin is under 5,000. In addition, the molecular weight of a cationic resin eventually affects the adjusted Hercules viscosity of the coating color, and using a cationic resin having a molecular weight exceeding 200,000 is not desirable in the present invention since the Hercules viscosity of the coating color rises. In addition, the ink fixing capability is not adequate when the anion demand of the cationic resin is under 5 meq/g.

As the cationic resin, for example, polyethylene imine quaternary ammonium salt derivatives; polyamine polyamide epihalohydrin polymers by condensation polymerization; polymers by condensation polymerization obtained by allowing ammonia to react with epihalohydrins and an amine such as a monoamine, a polyamine and the like (dialkylamine·ammonia·epichlorohydrin polymers by condensation polymerization and the like); dicyan diamide·formaldehyde resins; diethylenetriamine·dicyandiamide·ammonium chloride polymers; dimethyldiallyl ammonium chloride polymers and the like can be shown as examples. Of these, polymers by condensation polymerization obtained by allowing ammonia, amines and epihalohydrins to react are particularly preferred due to the excellent fixing performance of inkjet ink.

<Polymers by Condensation Polymerization Used in Cationic Resins>

Primary amines, secondary amines, tertiary amines, polyalkylene polyamines and alkanolamine monoamines can be cited as the amines in the polymers by condensation polymerization mentioned above. More specifically, dimethylamine, diethylamine, dipropylamine, methyl ethylamine, methyl propylamine, methyl butylamine, methyl octylamine, methyl laurylamine and dibenzylamine can be cited as the secondary amine. More specifically, trimethylamine, triethylamine, tripropylamine, tri-isopropylamine, tri-n-butylamine, tri-sec-butylamine, tri-tert-butylamine, tripentylamine, trihexylamine, trioctylamine and tribenzylamine can be cited as the tertiary amine. Of these dimethylamine and diethylamine, which are secondary amines, are particularly preferred.

As the epihalohydrins for the polymer by condensation polymerization described above, at least one compound selected from epichlorohydrin, epibromohydrin, epiiodohydrin, methyl epichlorohydrin and the like, for example, can be used. Of these, epichlorohydrin is most preferred. A well known method, for example, the one described in Unexamined Japanese Patent Publications (Kokai) Hei 10-152544 and Hei 10-147057, can be used as a synthetic method for the polymers by condensation polymerization mentioned above. One individual polymer may be added to a coating color as the polymers by condensation polymerization described above, and those polymers by condensation polymerization described above having different degrees of polymerization may be mixed and added to a coating color. In addition, the polymers by condensation polymerization described above may be obtained by appropriate synthesis, or a commercially available product may also be used.

<Application of the Coating Color>

In one embodiment of the present invention, an ink absorbing layer is applied and formed at a high speed (at least 300 m/min, and at least 1,000 m/min is also possible) using a transfer roll coater. This method significantly improves productivity, can easily form an ink absorbing layer on both sides of a base material and makes possible the inexpensive production of an inkjet recording medium that can be printed on both sides. A transfer roll coater applies a coating color onto a base material using a pre-metering method (print coating method) (a coating color metered using a multiple number of rolls, bars, blades and the like is applied to a base material using an application roll). The advantages associated with a transfer roll coater include a lower load on the paper during coating resulting in fewer breaks and a higher coating speed in comparison to applying a coating using a post-metering method (a method in which a coating color applying to a base material is scraped away) such as using blade coaters, bar coaters and the like.

A gate roll coater, a rod metering size press, a blade metering size press and the like can be cited as the transfer roll coater. These coating methods can simultaneously apply a coating to both sides of a base material, and can easily be set on a machine (a paper making machine). A transfer roll coater may be an on-machine coater or an off-machine coater. Here, an on-machine coater refers to a machine that is set on a machine (a paper making machine and the like) that manufactures a base material and coats a base material on the same line. An off-machine coater is set separately from a machine that manufactures a base material, and the base material manufactured is wound once before being coated using a coater on a separate line. The use of an on-machine coater transfer roll coater is preferred to reduce production costs by improving production efficiency.

The use of a gate roll coater to apply a coating, generally using three (a total of six for both sides) rolls per one side of a base material, is particularly preferred since the coating weight of the ink absorbing layer (the coated surface) is more uniform and inkjet printability, particularly the uniformity in solid image, is better compared to when a rod metering size press wherein a coating color is metered using a wire wound rod or a grooved rod. A blade coater, an air knife coater, a bar coater, a curtain coater and the like may be used to apply a coating when manufacturing a conventional inkjet recording medium. However, applying a coating on both sides of a base material simultaneously is difficult using these methods, and it is not practical in these methods to coat both sides due to the problems associated with the increase in the number of production processes and the enormous drying load.

<Hercules Viscosity of a Coating Color>

The viscosity of a coating color used for an ink absorbing layer in terms of its Hercules viscosity needs to be adjusted to from 5 mPa·s to 30 mPa·s at 8,800 rpm and 30° C. in order to make possible the coating application using a transfer roll coater. By controlling the Hercules viscosity within the range mentioned above, a high speed coating application using a transfer roll coater becomes stable and possible. When the Hercules viscosity of a coating color is under 5 mPa·s, a necessary coating weight, described below, cannot be obtained although problems are not encountered about the operation. Similarly, when the Hercules viscosity exceeds 30 mPa·s, the coated surface deteriorates when a transfer roll coater is used, and coating defects are encountered when a gate roll coater is used due to splashing (ordinarily referred to as "jumping") of the coating color, so this is unfavorable.

The Hercules viscosity of a coating color is adjusted by using the synthetic silica and/or precipitated calcium carbonate-silica composite mentioned above as the pigment. In addition, the Hercules viscosity becomes even easier to adjust when using PVA or a hydroxyethyl etherified starch both having a low degree of polymerization as a binder, or adding a cationic resin having a molecular weight of 200,000 or less to a coating color. Here, the Hercules viscosity refers to the viscosity (high shear viscosity) at high shear rate.

By adjusting the Hercules viscosity of a coating color to the range mentioned above in the manner described above, the coating weight for each side of a base material can preferably be controlled to from 2 g/m$^2$ to 7 g/m$^2$ in terms of solid content. An uneven coating is delivered and the surface of a base material may not be covered uniformly with an ink absorbing layer when the coating weight of a coating color described above is under 2 g/m$^2$. As a result, the ink absorption may become uneven and solid image also may be uneven, and the inkjet printability is sometimes adversely affected. Similarly, undesirable outcomes sometimes arise because operations may be adversely affected and flaking occurs when cutting a recording medium, when the coating weight exceeds 7 g/m$^2$.

In addition, controlling Brookfield viscosity and the concentration of a coating color in terms of solid content within a designated range is preferred in order to control the coating weight within the range mentioned above when using a transfer roll coater. Brookfield viscosity of coating color of from 10 mPa·s to 1,000 mPa·s is preferred. When the viscosity exceeds 1,000 mPa·s, it sometimes is difficult to deliver the coating color to a transfer roll coater, and the Hercules viscosity tends to rise. Similarly, when the viscosity is under 10 mPa·s, a coating weight sufficient for inkjet printability is sometimes difficult to obtain. The concentration in terms of solid content of a coating color is preferably 10% or more by weight, 20% or more is particularly preferred and 30% or more is most preferred. That is, when the concentration mentioned above is under 10%, a coating can be applied using a transfer roll coater but the solid content in a coating color is sometimes too low to realize an ink absorbing layer coating weight of at least 2 g/m$^2$. A higher concentration is preferred for the concentration mentioned above, but about 55% is ordinarily the upper limit and 45% is a preferred upper limit since practical problems are encountered when the concentration is too high. For example, the coating weight becomes difficult to control and the viscosity increases too much.

Additives such as a sizing agent, a dye, a fluorescent dye, a water retention agent, a waterproofing agent, a pH adjusting agent, an antifoaming agent, a lubricant, a preservative, a surfactant, a conductive agent, an ultraviolet ray absorption agent, an antioxidant and the like can be added to a coating color that forms an ink absorbing layer within ranges that do not adversely affect the effect of the present invention. The addition of a sizing agent is particularly desirable since it improves the sharpness of the printed area. As far as using various additives are concerned, cationic or nonionic additives are preferred from the standpoint of compatibility with the cationic resin mentioned above.

EXAMPLES

The present invention is explained in further detail by presenting specific examples below, but the present invention is not limited by these examples. In addition, the terms "parts" and "%" described below refer to "parts by weight" and "% by weight" unless otherwise noted and, in the case of aqueous solutions, the results represent calculations in terms of solid content.

<Measuring Coating Color Properties>

1. Average particle diameter of a pigment in a coating color: A sample (pigment) slurry was added by drop into pure water to which 0.2% of sodium hexa-meta-phosphate had been added as a dispersing agent to form a uniform dispersion. A laser particle size analyzer (Mastersizer S, a trade name of Malvern Instruments) was used for the measurements.

2. BET specific surface area for the pigment in a coating color: A Gemini 2360 model of Micrometrics Corporate was used, and the surface area was calculated using the amount of nitrogen adsorption.

3. Oil absorption of the pigment in a coating color: The measurements were made according to JIS K5101.

4. Measuring Hercules viscosity of a coating color: The measurements were made using a high shear viscometer (Kumagai Riki Kogyo, Model HR-801C) at 8,800 rpm and a liquid temperature of 30° C.

5. Measuring the Brookfield viscosity of a coating color: One Brookfield viscometer (Tokyo Keiki K.K.) was used to measure at a rotation of 60 rpm and a liquid temperature of 30° C.

<Production of Pigments (Synthetic Silica)>

(Synthetic Silica Production 1)

First step: Two hundred liters of a dilute sodium silicate solution containing 6.7% by weight of $SiO_2$ was prepared by diluting a commercially available No. 3 sodium silicate ($SiO_2$: 20.0%, $Na_2O$: 9.5%) using water in a reactor (200 liter). This sodium silicate solution was heated to 85° C., and aluminum sulfate corresponding to 20% of the neutralization equivalent ($Al_2O_3$ fraction concentration was 8% by weight, henceforth referred to as the "aluminum sulfate") was added by drop at a rate of 200 g/min. Sufficiently powerful agitation was used to prevent coarse gels from forming, and the amount of sulfuric acid (concentration of 98% by weight) corresponding to 30% of the neutralization equivalent was added, also under sufficiently powerful agitation as described above. Upon completion of the addition, the partially neutralized solution obtained was subjected to an aging treatment under agitation while a vertical sand grinder (capacity 7.57 liters, employing a 70% packing ratio of 1 mm diameter glass beads) was used to conduct a circulation grinding treatment with a target particle diameter of 7 μm. This aging and grinding treatment was conducted for three hours.

Second step: Next, the slurry temperature was raised to 90° C., sulfuric acid having the same concentration as used in the first step was added under conditions identical to those in the first step until an amount corresponding to 80% of the neutralization equivalent was added. The mixture was aged for 32 minutes with agitation.

Third step: Subsequently sulfuric acid having the same concentration as described above was added at an addition rate of 76 g/min to the slurry after aging to adjust the slurry pH to 6.

Grinding by wet grinding: The slurry was filtered and washed with water upon completion of the third step and was re-dispersed using pure water to recover a silicic acid hydrate slurry. The slurry obtained was diluted to the concentration at which it became fluid and was wet ground by adding this diluted slurry into a horizontal sand grinder packed with 0.6 mm to 0.8 mm diameter glass beads (Pofters-Ballotini Co. Ltd.) at a packing ratio of 80%.

(Synthetic Silica Production 2)

A slurry was obtained and wet ground in the manner described in the Synthetic Silica Production 1 with the exception of not using the aluminum sulfate in the first step described above but using sulfuric acid for the entire 100% of the neutralization equivalent.

(Synthetic Silica Production A-G)

Five synthetic silicas shown below were obtained by adjusting the wet grinding treatment time in the procedure described in Synthetic Silica Production 1. A silica having an oil absorption of 147 ml/100 g, a BET specific surface area of 80 $m^2/g$ and an average particle diameter of 2.1 μm was labeled synthetic silica A. Similarly, a silica having an oil absorption of 122 ml/100 g, a BET specific surface area of 83 $m^2/g$ and an average particle diameter of 1.3 μm was labeled synthetic silica B. A silica having an oil absorption of 170 ml/100 g, a BET specific surface area of 81 $m^2/g$ and an average particle diameter of 2.7 μm was labeled synthetic silica C. A silica having an oil absorption of 214 ml/100 g, a BET specific surface area of 78 $m^2/g$ and an average particle diameter of 3.4 μm was labeled synthetic silica D. A silica having an oil absorption of 82 ml/100 g, a BET specific surface area of 95 $m^2/g$ and an average particle diameter of 0.5 μm was labeled synthetic silica E.

In addition, silicas obtained by adjusting the wet grinding time in the procedure described in Synthetic Silica Production 2 were labeled synthetic silica F and G. Synthetic silica F had an oil absorption of 177 ml/100 g, a BET specific surface area of 104 $m^2/g$ and an average particle diameter of 2.2 μm. Synthetic silica G had an oil absorption of 135 ml/100 g, a BET specific surface area of 102 $m^2/g$ and an average particle diameter of 0.6 μm.

<Production of Precipitated Calcium Carbonate-Silica Composite A>

A commercially available rosette type precipitated calcium carbonate (Trade name: Albacar 5970, Specialty Minerals Inc., average particle diameter 3.0 μm) in an amount of 262 g was dispersed in water in a reactor (12 liter), and 3,400 g of a sodium silicate solution ($SiO_2$ concentration 18.0 wt/wt % and $Na_2O$ concentration 6.1 wt/wt %) was added. Water was subsequently added to attain a total volume of 12 liters. The mixture slurry temperature was raised to 85° C. with enough agitation using laboratory agitator. A 10% sulfuric acid solution was added to this slurry using a rotary pump, and this addition was directed to a location directly under the agitator blades of a laboratory agitator so that the added sulfuric acid was adequately agitated. The sulfuric acid addition was executed at a constant temperature and constant rate under the conditions described above to adequately disperse the added sulfuric acid so that the final slurry pH upon completion of the sulfuric acid addition became 8.0 and the total sulfuric acid addition was conducted over 240 minutes. The slurry obtained was processed using a 100 mesh screen to separate out coarse particles and was subsequently suction filtered through a No. 2 filter paper to obtain a precipitated calcium carbonate-silica composite A having a precipitated calcium carbonate/silica weight ratio of 30/70. The oil absorption of this composite was 180 ml/100 g, the BET specific surface area was 30 $m^2/g$ and the average particle diameter was 7.3 μm.

<Production of Precipitated Calcium Carbonate-Silica Composite B>

A precipitated calcium carbonate-silica composite B having a precipitated calcium carbonate/silica weight ratio of 50/50, an oil absorption of 160 ml/100 g, a BET specific surface area of 28 $m^2/g$ and an average particle diameter of 4.4 μm was obtained in the same manner described for the production of the precipitated calcium carbonate-silica composite A described above with the exception that the dispersion amount of the rosette type precipitated calcium carbonate mentioned above was 612 g.

<Production of Precipitated Calcium Carbonate-Silica Composite C>

A precipitated calcium carbonate-silica composite C having a precipitated calcium carbonate/silica weight ratio of 70/30, an oil absorption of 140 ml/100 g, a BET specific surface area of 26 $m^2/g$ and an average particle diameter of 3.6 μm was obtained in the same manner described for the production of the precipitated calcium carbonate-silica composite A described above with the exception that the dispersion amount of the rosette type precipitated calcium carbonate mentioned above was 1,436 g.

Example 1

Fifteen parts of calcium carbonate used as a filler, 0.4% internal sizing agent (Sizepine NT-87: by Arakawa Chemical Industries, Ltd.) and 0.8 part of cationized starch were added to 100 parts of a pulp slurry comprising bleached hard wood kraft pulp (freeness of 350 ml c.s.f.), and a twin wire paper machine was used to make a base material, X of weighing 80 $g/m^2$. A coating color (solid content: 28%, Hercules viscosity: 19.0 mPa·s, Blookfield viscosity: 300 mPa·s) comprising 100 parts of synthetic silica A, 50 parts of poly(vinyl alcohol) (PVA 103: by KURARAY Co., LTD.), 20 parts of cationic resin [poly(amine ammonia epichlorohydrin), anion requirement: 6 meq/g, molecular weight 100,000] and 10 parts of a cationic sizing agent (SS335: by SEIKO PMC CORPORATION) was applied at a speed of 1,000 m/min to both sides of the base material X using an on-machine gate roll coater. An inkjet recording medium sample was obtained by drying and further subjecting a calendering treatment [line pressure 1960 N/cm (200 kgf/cm)·2NIP]. The coating weight of the coating color was 4.7 $g/m^2$ per side.

Example 2

A coating color (solid content: 28%, Hercules viscosity: 19.8 mPa·s, Blookfield viscosity: 340 mPa·s) was prepared in the same manner described in Example 1 with the exception that 100 parts of synthetic silica B was used in place of synthetic silica A. This coating color was coated on the base material X in the same manner as in Example 1, and a recording medium sample was obtained. The coating weight of the coating color was 4.7 $g/m^2$ per side.

Example 3

A coating color (solid content: 28%, Hercules viscosity: 19.5 mPa·s, Blookfield: 280 mPa·s) was prepared in the same manner described in Example 1 with the exception that 100 parts of synthetic silica C was used in place of synthetic silica A. This coating color was coated on the base material X in the same manner as in Example 1, and a recording medium sample was obtained. The coating weight of the coating color was 5.2 g/m$^2$ per side.

Example 4

A recording medium sample was obtained in the same manner described in Example 1 with the exception that the coating weight of the coating color was 2.5 g/m$^2$ per side.

Example 5

A recording medium sample was obtained in the same manner described in Example 1 with the exception that the coating weight of the coating color was 6.7 g/m$^2$ per side.

Example 6

A recording medium sample was obtained in the same manner described in Example 1 with the exception that the coating weight of the coating color was 9.2 g/m$^2$ per side.

Example 7

A recording medium sample was obtained in the same manner described in Example 1 with the exception that a coating color (solid content: 30%, Hercules viscosity: 19.9 mPa·s, Blookfield viscosity: 620 mPa·s) comprising 50 parts of precipitated calcium carbonate H (Tama Pearl 123CS: by Okutama Kogyo Co., Ltd. , average particle diameter 0.3 μm), 25 parts of poly(vinyl alcohol) (PVA 103: by KURARAY Co., LTD.), 25 parts of hydroxyethyl etherified starch (Penford Gum 295: by Nissei Kyoeki Co., Ltd.), 20 parts of a cationic resin [poly(amine ammonia epichlorohydrin), anion requirement: 6 meq/g, molecular weight 100,000] and 10 parts of a cationic sizing agent (SS335: by SEIKO PMC CORPORATION) per 50 parts of synthetic silica A. The coating weight of the coating color was 4.6 g/m$^2$ per side.

Example 8

A recording medium sample was obtained in the same manner described in Example 1 with the exception that a coating color (solid content: 30%, Hercules viscosity: 19.1 mPa·s, Blookfield viscosity: 580 mPa·s) comprising 50 parts of precipitated calcium carbonate H (Tama Pearl 123CS: by Okutama Kogyo Co., Ltd.), 25 parts of poly(vinyl alcohol) (PVA 103: by KURARAY Co., LTD.), 25 parts of hydroxyethyl etherified starch (Penford Gum 295: by Nissei Kyoeki Co., Ltd.), 20 parts of a cationic resin [poly(amine ammonia epichlorohydrin), anion requirement: 6 meq/g, molecular weight 5,000] and 10 parts of a cationic sizing agent (SS335: by SEIKO PMC CORPORATION) per 50 parts of synthetic silica A was used. The coating weight of the coating color was 5.3 g/m$^2$ per side.

Example 9

A recording medium sample was obtained in the same manner described in Example 1 with the exception that a coating color (solid content: 30%, Hercules viscosity: 19.4 mPa·s, B type viscosity: 600 mPa·s) comprising 50 parts of precipitated calcium carbonate H (Tama Pearl 123CS: by Okutama Kogyo Co., Ltd.), 25 parts of poly(vinyl alcohol) (PVA 103: by KURARAY Co., LTD.), 25 parts of hydroxyethyl etherified starch (Penford Gum 295: by Nissei Kyoeki Co., Ltd.), 20 parts of a cationic resin [poly(amine ammonia epichlorohydrin), anion requirement: 3 meq/g, molecular weight 100,000] and 10 parts of a cationic sizing agent (SS335: by SEIKO PMC CORPORATION) per 50 parts of synthetic silica A was used. The coating weight of the coating color was 4.6 g/m$^2$ per side.

Example 10

A recording medium sample was obtained in the same manner described in Example 1 with the exception that a coating color (solid content: 30%, Hercules viscosity: 20.2 mPa·s, B type viscosity: 650 mPa·s) comprising 50 parts of precipitated calcium carbonate H (Tama Pearl 123CS: by Okutama Kogyo Co., Ltd.), 25 parts of poly(vinyl alcohol) (PVA 103: by KURARAY Co., LTD.), 25 parts of hydroxyethyl etherified starch (Penford Gum 295: by Nissei Kyoeki Co., Ltd.), 20 parts of a cationic resin [poly(amine ammonia epichlorohydrin), anion requirement: 7 meq/g, molecular weight 500,000] and 10 parts of a cationic sizing agent (SS335: by SEIKO PMC CORPORATION) per 50 parts of synthetic silica A was used. The coating weight of the coating color was 4.6 g/m$^2$ per side.

Example 11

A recording medium sample was obtained in the same manner described in Example 1 with the exception that 100 parts of synthetic silica F was used in place of synthetic silica A and preparing a coating color (solid content: 23%, Hercules viscosity: 10.6 mPa·s, Blookfield viscosity: 260 mPa·s). This coating color was applied in the same manner described in Example 1. The coating weight of the coating color was 2.4 g/m$^2$ per side.

Example 12

Ten parts of kaolin as a filler and 1.0 part of the aluminum sulfate were added to 100 parts of a pulp slurry comprising a bleached hard wood kraft pulp (freeness of 450 ml c.s.f.), and a twin wire paper machine was used to make a base material Y of weighing 80 g/m$^2$. A recording medium sample was obtained by applying a coating color in the same manner described in Example 1 to both sides of the base material Y at a coating speed of 500 m/min using an on-machine blade metering size press and further subjecting it to a calendering treatment [line pressure 1960 N/cm (200 kgf/cm)-1 NIP] after drying. The coating weight of the coating color was 5.1 g/m$^2$ per side.

Example 13

A recording medium sample was obtained by applying to both sides of the base material Y described above a coating color (solid content: 23%, Hercules viscosity: 28.3 mPa·s, Blookfield viscosity: 650 mPa·s) comprising 100 parts of precipitated calcium carbonate-silica composite A, 20 parts of poly(vinyl alcohol) (PVA 117: by KURARAY Co., LTD.), 5 parts of parts of poly(vinyl alcohol) (PVA 103: by KURARAY Co., LTD.), 25 parts of hydroxyethyl etherified starch (Penford Gum 295: by Nissei Kyoeki Co., Ltd.), 20 parts of a cationic resin [poly(amine ammonia epichlorohydrin), anion requirement: 6 meq/g, molecular weight 100,000] and 10 parts of a cationic sizing agent (SS335: by SEIKO PMC CORPORATION) at a speed of 500 m/min using an on-machine blade metering size press and further subjecting it to a calendering treatment [line pressure 1960 N/cm (200 kgf/cm)·1 NIP] after drying. The coating weight of the coating color was 3.6 g/m$^2$ per side.

Example 14

A recording medium sample was obtained by preparing a coating color (solid content: 25%, Hercules viscosity: 25.6 mPa·s, Blookfield viscosity: 630 mPa·s) in the same manner described in Example 13, with the exception that precipitated calcium carbonate-silica composite B was used in place of precipitated calcium carbonate-silica composite A, and applying this coating color in the same manner described in Example 13 to the base material Y. The coating weight of the coating color was 3.4 g/m$^2$ per side.

Example 15

A recording medium sample was obtained by preparing a coating color (solid content: 25%, Hercules viscosity: 24.3 mPa·s, Blookfield viscosity: 590 mPa·s) in the same manner described in Example 13, with the exception that precipitated calcium carbonate-silica composite C was used in place of precipitated calcium carbonate-silica composite A, and applying this coating color in the same manner described in Example 13 to the base material Y. The coating weight of the coating color was 3.3 g/m$^2$ per side.

Comparative Example 1

A coating color (solid content: 30%, Hercules viscosity: 21.8 mPa·s, B type viscosity: 320 mPa·s) was prepared in the same manner described in Example 1 with the exception that 100 parts of synthetic silica D was used in place of synthetic silica A. This coating color was coated on the base material X in the same manner as in Example 1, and a recording medium sample was obtained. The coating weight of the coating color was 5.1 g/m$^2$ per side.

Comparative Example 2

A coating color (solid content: 28%, Hercules viscosity: 18.5 mPa·s, Blookfield viscosity: 360 mPa·s) was prepared in the same manner described in Example 1 with the exception that 100 parts of synthetic silica E was used in place of synthetic silica A. This coating color was coated on the base material X in the same manner as in Example 1, and a recording medium sample was obtained. The coating weight of the coating color was 5.0 g/m$^2$ per side.

Comparative Example 3

A recording medium sample was obtained in the same manner described in Example 1 with the exception that a coating color (solid content: 25%, Hercules viscosity: 17.0 mPa·s, Blookfield: 540 mPa·s) comprising 40 parts of poly (vinyl alcohol) (PVA 103: by KURARAY Co., LTD.), 40 parts of hydroxyethyl etherified starch (Penford Gum 295: by Nissei Kyoeki Co., Ltd.), 20 parts of a cationic resin [poly (amine ammonia epichlorohydrin), anion requirement: 6 meq/g, molecular weight 100,000] and 10 parts of a cationic sizing agent (SS335: by SEIKO PMC CORPORATION) per 100 parts of silica (Finesil X37, by Tokuyama Corp., oil absorption: 260 ml/100 g, BET specific surface area: 275 m$^2$/g, average particle diameter: 2.7 μm) was used. The coating weight of the coating color was 4.9 g/m$^2$ per side. The surface strength of this sample was poor, and some of the coating layer was lost while drying.

Comparative Example 4

An attempt was made to apply a coating color (solid content: 20%, Hercules viscosity: 39.5 mPa·s, Blookfield viscosity: 700 mPa·s) comprising 50 parts of poly(vinyl alcohol) (PVA 117: by KURARAY Co., LTD.), 20 parts of a cationic resin [poly(amine ammonia epichlorohydrin), anion requirement: 6 meq/g, molecular weight 100,000] and 10 parts of a cationic sizing agent (SS335: by SEIKO PMC CORPORATION) per 100 parts of synthetic silica A on the base material X in the same manner used in Example 1. The coating color splashed (jumped) notably, and a recording medium sample could not be obtained.

Comparative Example 5

A recording medium sample was obtained in the same manner described in Example 1 with the exception that a coating color (solid content: 28%, Hercules viscosity: 19.7 mPa·s, Blookfield viscosity: 650 mPa·s) comprising 50 parts of poly(vinyl alcohol) (PVA 103: by KURARAY Co., LTD.), 20 parts of a cationic resin [poly(amine ammonia epichlorohydrin), anion requirement: 6 meq/g, molecular weight 100,000] and 10 parts of a cationic sizing agent (SS335: by SEIKO PMC CORPORATION) per 100 parts of dry ground silica (NIPSIL E743: by TOSOH SILICA CORPORATION, oil absorption: 160 ml/100 g, BET specific surface area: 40 m$^2$/g, average particle diameter: 1.5 μm) was used. The coating weight of the coating color was 4.9 g/m$^2$ per side. The coating layer was lost to some extent when this sample was dried.

Comparative Example 6

A coating color (solid content: 23%, Hercules viscosity: 12.5 mPa·s, Blookfield viscosity: 280 mPa·s) was prepared in the same manner described in Example 12 with the exception that synthetic silica G was used in place of synthetic silica A. This coating color was coated on the base material Y in the same manner as in Example 12, and a recording medium sample was obtained. The coating weight of the coating color was 2.5 g/m$^2$ per side.

<Evaluation>

The evaluations of the individual Examples and comparative examples were conducted using the methods described below.

(1) Optical Density.

An inkjet printing sample (black) was prepared using a SCITEX 6240 system printer (Scitex Digital Printing Inc.), and optical density after 24 hours was measured using a Macbeth Densitometer (RD918: a trade name of Gretag Macbeth AG.). When optical density was under 1.2, a unfavorable decrease in optical density was noticeable.

(2) Ink Absorption Properties.

The ink absorption properties were visually evaluated from a sample inkjet printing (black solid image) obtained using the SCITEX 6240 system printer described above.

◎: Very rapid absorption.

○: Rapid absorption.

Δ: Absorption was somewhat slow but not slow enough to cause practical problems.

X: Slow absorption associated with staining devices and printed area. Not usable.

(3) Water Resistance.

The letter "den(kanji)" was inkjet printed (black) on a sample using the SCITEX 6240 printer mentioned above. Twenty microliters of water was added by drops on the printed area after three hours elapsed to evaluate the water resistance.

○: Almost no blurring was observed.

Δ: Blurring was observed in printed areas but letters were legible.

X: Printed area blurred, and letters were almost illegible.

(4) Offset Printability

An off set printer (printing speed: 70 m/min) was used for printing, and the printed sample was evaluated.

◎: Printing operations proceeded with no problem.

○: The coating layer slightly flaked, but printing operations proceeded with no problem.

Δ: Slight piling on rubber blanket and poor ink coverage were encountered, but printing operations could proceed.

X: Piling on rubber blanket and poor ink coverage were encountered, and printing operational problems occurred.

(5) The Runnability of the Coating when Using an On-Machine Coater.

○: Almost no splash (jumping) of a coating color was observed, and almost no coating layer roughening was encountered.

Δ: Slight splash (jumping) of a coating color was observed, and operational efficiency declined.

X: Splash (jumping) of a coating color was observed, and serious operational problems occurred.

The results obtained are shown in Tables 1 and 2. The synthetic silica and precipitated calcium carbonate-silica composite are reported as "silica type pigments".

TABLE 1

| | | Properties of silica based pigment in the coating solution | | Av. Particle diameter | Ratio of (precipitated calcium | Properties of the coating solution | | | |
|---|---|---|---|---|---|---|---|---|---|
| | Pigment type | Oil absorption (mL/100 g) | BET specific surface area ($m^2/g$) | of silica based pigment (μm) | carbonate/silica) in the pigment | Coating weight on one side ($g/m^2$) | Hercules viscosity (mPa · s) | Brookfield viscosity (mPa · s) | concentration in solid content (% by wt.) |
| Example. 1 | Synthetic silica A | 147 | 80 | 2.1 | 0/100 | 4.7 | 19.0 | 300 | 28.0 |
| Example. 2 | Synthetic silica B | 122 | 83 | 1.3 | 0/100 | 4.7 | 19.8 | 340 | 28.0 |
| Example. 3 | Synthetic silica C | 170 | 81 | 2.7 | 0/100 | 5.2 | 19.5 | 280 | 28.0 |
| Example. 4 | Synthetic silica A | 147 | 80 | 2.1 | 0/100 | 2.5 | 19.0 | 300 | 28.0 |
| Example. 5 | Synthetic silica A | 147 | 80 | 2.1 | 0/100 | 6.7 | 19.0 | 300 | 28.0 |
| Example. 6 | Synthetic silica A | 147 | 80 | 2.1 | 0/100 | 9.2 | 19.0 | 300 | 28.0 |
| Example. 7 | Synthetic silica A + Light calcium carbonate H | 147 | 80 | 2.1 | 50/50 | 4.6 | 19.9 | 620 | 30.0 |
| Example. 8 | Synthetic silica A + Light calcium carbonate H | 147 | 80 | 2.1 | 50/50 | 5.3 | 19.1 | 580 | 30.0 |
| Example. 9 | Synthetic silica A + Light calcium carbonate H | 147 | 80 | 2.1 | 50/50 | 4.6 | 19.4 | 600 | 30.0 |
| Example. 10 | Synthetic silica A + Light calcium carbonate H | 147 | 80 | 2.1 | 50/50 | 4.6 | 20.2 | 650 | 30.0 |
| Example. 11 | Synthetic silica F | 177 | 104 | 2.2 | 0/100 | 2.4 | 10.6 | 260 | 23.0 |
| Example. 12 | Synthetic silica A | 147 | 80 | 2.1 | 0/100 | 5.1 | 19.0 | 300 | 28.0 |
| Example. 13 | Light calcium carbonate-silica composite A | 180 | 30 | 7.3 | 30/70 | 3.6 | 28.3 | 650 | 23.0 |
| Example. 14 | Light calcium carbonate-silica composite B | 160 | 28 | 4.4 | 50/50 | 3.4 | 25.6 | 630 | 25.0 |
| Example. 15 | Light calcium carbonate-silica composite C | 140 | 26 | 3.6 | 70/30 | 3.3 | 24.3 | 590 | 25.0 |
| Comp. Ex. 1 | Synthetic silica D | 214 | 78 | 3.4 | 0/100 | 5.1 | 21.8 | 320 | 30.0 |
| Comp. Ex. 2 | Synthetic silica E | 82 | 95 | 0.5 | 0/100 | 5.0 | 18.5 | 360 | 28.0 |
| Comp. Ex. 3 | Silica | 260 | 275 | 2.7 | 0/100 | 4.9 | 17.0 | 540 | 25.0 |
| Comp. Ex. 4 | Synthetic silica A | 147 | 80 | 2.1 | 0/100 | Coating impossible | 39.5 | 700 | 20.0 |
| Comp. Ex. 5 | Dry method silica | 160 | 40 | 1.5 | 0/100 | 4.9 | 19.7 | 650 | 28.0 |
| Comp. Ex. 6 | Synthetic silica G | 135 | 102 | 0.6 | 0/100 | 2.5 | 12.5 | 280 | 23.0 |

TABLE 2

| | | Evaluation results | | | | |
|---|---|---|---|---|---|---|
| | Coating method | optical density (O.D.) | Ink absorption | Water resistance | Off-set printability | On-machine runnability of the coating |
| Example. 1 | Gate roll | 1.33 | ○ | ○ | ○ | ○ |
| Example. 2 | Gate roll | 1.30 | ○ | ○ | ○ | ○ |
| Example. 3 | Gate roll | 1.31 | ○ | ○ | ○ | ○ |
| Example. 4 | Gate roll | 1.29 | Δ | ○~Δ | ○ | ○ |
| Example. 5 | Gate roll | 1.34 | ○ | ○ | ○ | ○ |
| Example. 6 | Gate roll | 1.33 | ◎ | ○ | Δ | ○ |
| Example. 7 | Gate roll | 1.30 | ○ | ○ | ◎ | ○ |
| Example. 8 | Gate roll | 1.23 | ○ | ○ | ◎ | ○ |
| Example. 9 | Gate roll | 1.35 | ○ | Δ | ◎ | ○ |
| Example. 10 | Gate roll | 1.34 | ○ | Δ | ◎ | ○ |
| Example. 11 | Gate roll | 1.25 | Δ | ○ | ○ | ○ |
| Example. 12 | Blade metering size press | 1.32 | ○ | ○ | ○ | ○ |

TABLE 2-continued

| | Coating method | Evaluation results | | | | |
|---|---|---|---|---|---|---|
| | | optical density (O.D.) | Ink absorption | Water resistance | Off-set printability | On-machine runnability of the coating |
| Example. 13 | Blade metering size press | 1.28 | ◎ | ○ | Δ | ○ |
| Example. 14 | Blade metering size press | 1.24 | ◎ | ○ | Δ | ○ |
| Example. 15 | Blade metering size press | 1.21 | ◎ | ○ | Δ | ○ |
| Comp. Ex. 1 | Gate roll | 1.22 | ◎ | ○ | Δ~X | Δ |
| Comp. Ex. 2 | Gate roll | 1.12 | X | ○ | ○ | ○ |
| Comp. Ex. 3 | Gate roll | 1.33 | ◎ | ○ | X | X |
| Comp. Ex. 4 | Gate roll | — | — | — | — | — |
| Comp. Ex. 5 | Gate roll | 1.29 | X | ○ | Δ~X | Δ |
| Comp. Ex. 6 | Blade metering size press | 1.10 | Δ | ○ | ○ | ○ |

The data reported in Tables 1 and 2 clearly indicated that the inkjet recording medium of each Example had excellent optical density, water resistance, offset printability and on-machine coating adaptability, was receptive to offset printing and both sides printing and could be manufactured using an on-machine transfer roll coater.

The offset printability was most exceptional in Examples 7-10 wherein synthetic silica and precipitated calcium carbonate were added as the pigment. In Example 6 wherein the coating weight exceeded 7 g/m$^2$, the offset printability was slightly inferior to that of other Examples but no problem was encountered in practice. In addition, in Example 11 wherein the aqueous sodium silicate solution was neutralized using only a mineral acid when manufacturing synthetic silica, the coating weight used was 2.4 g/m$^2$ since the coating application tended to proceed unevenly when an attempt was made to maintain a higher coating weight (above about 4.6 g/m$^2$), so slight coating difficulties were encountered, but no practical problems were experienced.

In addition, the ink absorption was particularly excellent in Examples 13-15 when a precipitated calcium carbonate-silica composite was used as the pigment.

In contrast, the offset printability declined extensively in Comparative Example 1 when the oil absorption of the synthetic silica in the pigment exceeded 200 ml/100 g and the average particle diameter exceeded 3.0 μm. In addition, the optical density declined extensively in Comparative Example 2 when the oil absorption of the synthetic silica in the pigment was under 90 ml/100 g and the average particle diameter was under 1.0 μm. The offset printability and on-machine runnability of the coating both declined extensively in Comparative Example 3 when the oil absorption of the synthetic silica in the pigment exceeded 200 ml/100 g and the BET specific surface area exceeded 200 m$^2$/g. A coating color could not be applied using an on-machine gate roll coater in Comparative Example 4 when the Hercules viscosity of the coating color exceeded 30 mPa·s.

Furthermore, ink absorption and offset printability declined extensively in Comparative Example 5 when the BET specific surface area of the synthetic silica in the pigment was under 45 m$^2$/g. The optical density declined extensively in Comparative Example 6 when the average particle diameter was under 1.0 μm.

An inkjet recording medium having excellent inkjet printability (optical density, water resistance and the like) combined with offset printability can be manufactured with high productivity using the method of the embodiments of the present invention for an inkjet recording medium. In addition, ink absorbing layers can be formed on both sides.

What is claimed is:

1. A method for manufacturing an inkjet recording medium for offset printing comprising the steps of: applying at a speed of at least 300 m/minute and up to 1000 m/minute a coating color containing a pigment and a binder as major components to at least one side of a base material using a transfer roll coater; subsequently drying said coating layer to form an ink absorbing layer, wherein the Hercules viscosity of said coating color is 5 mPa·s to 30 mPa·s and said pigment contains either one of a) a synthetic silica having an oil absorption of 90 ml/100 g to 200 ml/100 g, a BET specific surface area of 80 m$^2$/g to 104 m$^2$/g and an average particle diameter of 1.0 μm to 3.0 μm, b) a precipitated calcium carbonate-silica composite having an oil absorption of 100 ml/100 g to 250 ml/100 g, a BET specific surface area of 26 m$^2$/g to 30 m$^2$/g and an average particle diameter of 1.0 μm to 10 μm, or a mixture of a) and b).

2. The method described in claim 1 wherein the pigment is a synthetic silica obtained by wet grinding a synthetic silica slurry obtained by neutralizing an aqueous sodium silicate solution using a mineral acid and/or an aqueous acidic metal salt solution.

3. The method described in claim 2 wherein said synthetic silica is obtained by neutralizing an aqueous sodium silicate solution using an aqueous aluminum sulfate solution.

4. The method described in claim 2 further comprising the step of adding said synthetic silica obtained by wet grinding said synthetic silica slurry to said coating color without proceeding through a drying step.

5. The method described in claim 1 wherein said transfer roll coater is a gate roll coater.

6. The method described in claim 1 wherein the coating weight of said ink absorbing layer per one side is 2 g/m$^2$ to 7 g/m$^2$.

7. The method described in claim 1 wherein said coating color contains a cationic resin.

8. The method described in claim 2 wherein said transfer roll coater is a gate roll coater.

9. The method described in claim 2 wherein the coating weight of said ink absorbing layer per one side is 2 g/m$^2$ to 7 g/m$^2$.

10. The method described in claim 2 wherein said coating color contains a cationic resin.

11. A method for manufacturing an inkjet recording medium for offset printing comprising the steps of: applying at a speed of at least 300 m/minute and up to 1000 m/minute a coating color containing a pigment and a binder as major components to at least one side of a base material using a transfer roll coater; subsequently drying said coating layer to form an ink absorbing layer, wherein the Hercules viscosity of said coating color is 5 mPa·s to 30 mPa·s and said pigment contains a precipitated calcium carbonate-silica composite having an oil absorption of 100 ml/100 g to 250 ml/100 g, a BET specific surface area of 26 $m^2/g$ to 30 $m^2/g$ and an average particle diameter of 1.0 μm to 10 μm or a mixture thereof with a synthetic silica having an oil absorption of 90 ml/100 g to 200 ml/100 g, a BET specific surface area of 80 $m^2/g$ to 104 $m^2/g$ and an average particle diameter of 1.0 μm to 3.0 μm.

12. The method described in claim 11 wherein said transfer roll coater is a gate roll coater.

13. The method described in claim 11 wherein said precipitated calcium carbonate-silica composite is obtained by mixing a precipitated calcium carbonate with an aqueous alkaline metal silicate solution and adjusting pH of said mixed solution to 7-9 by adding a mineral acid at a temperature below the boiling point of said mixed solution.

14. The method described in claim 13 wherein the ratio by weight for precipitated calcium carbonate/silica in said precipitated calcium carbonate-silica composite is 30/70 to 70/30 in terms of solid content.

15. The method described in claim 14 further comprising the step of adding precipitated calcium carbonate-silica composite to said coating color without proceeding through a drying step.

16. The method described in claim 13 further comprising the step of adding said precipitated calcium carbonate-silica composite to said coating color without proceeding through a drying step.

* * * * *